US005134031A

United States Patent [19]

Kagechi et al.

[11] Patent Number: 5,134,031

[45] Date of Patent: Jul. 28, 1992

[54] HIGHLY MOISTURE-ABSORPTIVE FIBER

[75] Inventors: Shunsaku Kagechi, Osaka; Nobuo Kusamoto, Tokyo; Yasuji Kawamura, Ichihara, all of Japan

[73] Assignees: Descente Ltd., Osaka; Idemitsu Petrochemical Co., Tokyo, both of Japan

[21] Appl. No.: 552,054

[22] Filed: Jul. 13, 1990

[30] Foreign Application Priority Data

Apr. 25, 1990 [JP] Japan ..... 2-109005
Apr. 25, 1990 [JP] Japan ..... 2-109006

[51] Int. Cl.[5] ..... C08L 89/06; D02G 3/00

[52] U.S. Cl. ..... 428/373; 428/374; 428/376; 428/398; 428/400; 8/404; 8/478; 524/10; 524/11

[58] Field of Search ..... 428/373, 374, 376, 398, 428/400; 8/115.5; 524/10, 11

[56] References Cited

U.S. PATENT DOCUMENTS 3,039,524 6/1962 Belck et al. ..... 8/115.5
3,053,609 9/1962 Miller ..... 8/115.5
3,807,917 4/1974 Shimoda et al. ..... 264/171
3,843,803 10/1974 Yano et al. ..... 426/56

*Primary Examiner*—George F. Lesmes
*Assistant Examiner*—Kathryne E. Shelborne
*Attorney, Agent, or Firm*—Oblon, Spivak, McClelland, Maier & Neustadt

[57] ABSTRACT

A highly moisture-absorptive fiber obtained by mixing and kneading one or more kinds of animal protein fibers, general protein forming the animal skin, bones, and others, pulverized to very fine powder of the 0.05 to 15 μm size with a polymer of synthetic fiber, semi-synthetic fiber or regenerated fiber or polymer of chemical fiber material consisting of a mixture of more than two kinds of these polymers and spinning the kneaded composition, which can give a fine fiber having flexibility and proper elongation.

10 Claims, 5 Drawing Sheets

HIGHLY MOISTURE-ABSORPTIVE FIBER

BACKGROUND OF THE INVENTION

This invention relates to the technology for commercialization of composite fiber materials and particularly to the highly moisture-absorptive fiber excellent in moisture absorptivity and moisture permeability, capable of being freely knitted or woven, and having good touch and feeling.

As substitute fiber materials for natural fiber, various kinds of fibers including regenerated fibers such as rayon, semi-synthetic fibers such as acetate, and synthetic fibers such as polyurethane, nylon, polyester, acryl, polyethylene and polypropylene have conventionally been in popular use. However, these fiber materials were all inferior in moisture absorptivity and moisture permeability as well as in touch and feeling to the natural fiber, even in case of the polyurethane being a synthetic fiber material having a relatively excellent moisture absorptivity and moisture permeability.

For this reason, there is an idea that a composite fiber material obtained by pulverizing natural leather to the particle size capable of passing through the 50 to 250 mesh sieve, mixing and kneading these particles with synthetic resin such as nylon and vinyl acetate and spinning the mixture into filaments should be used to improve the moisture absorptivity and touch.

However, mixing and kneading of natural leather powder with synthetic fiber material led to the poor spinning performance due to the adverse influence exerted on the spinning machine such as occurrence of clogging because the synthetic fiber becomes lacking in flexibility, poorer in elongation characteristics and thus liable to break. Moreover, the natural leather powder to be mixed and kneaded with the synthetic fiber material has a particle size only enough to pass through the 50 to 250 mesh sieve, the fiber must be designed to be considerably thick as compared with general fibers, thus resulting in "thick, hard and fragile" one. Furthermore, such composite fiber material was not applicable to actual textile products and was thus of little practical use because it is slow in moisture absorbing and desorbing speed, though its water-holding performance is improved.

BRIEF SUMMARY OF THE INVENTION

An object of this invention is to provide a composite fiber material which can be put into actual use through the improvements made on said composite fiber material to eliminate its drawbacks by using not only the animal leather powder, but also a wide variety of similar materials, and particularly to provide a highly moisture-absorptive fiber having the following characteristic features:

(1) A composite fiber material giving a dry touch due to its good moisture absorptivity.
(2) A composite fiber material excellent in chill-preventive effect due to its inhibitory action for dew condensation.
(3) A composite fiber material giving the feeling and touch similar to those of natural fiber.
(4) A composite fiber material having a good spinning performance.

The highly moisture-absorptive fiber of this invention is obtained by mixing and kneading one or more kinds of animal protein fibers pulverized to very fine powder of the 0.05 to 15 μm size with a polymer of synthetic fiber, semi-synthetic fiber or regenerated fiber or polymer of chemical fiber material consisting of a mixture of more than two kinds of these polymers and spinning the kneaded composition.

The term "Animal Protein Fiber" used here means the general protein forming the animal skin, bones, tendons, hairs, furs, and feathers including human hairs often called the "Collagen Fiber" or "Keratin Fiber" and is applicable to all animal leathers such as oxhides, cowhides, pigskins and sheepskins as well as birdskins. It also includes the carapaces of Crustacea such as shrimps, lobsters and crabs often called the "Chitin".

Further, the term "animal protein fibers pulverized to very fine powder of the 0.05 to 15 μm size" means the animal protein fibers pulverized to the particle size far smaller than that of powder passing through the sieve.

In addition, the highly moisture-absorptive fiber of this invention can be spun into a core-sheath structure by coating the surface of other fiber material such as chemical fiber material mentioned later with said kneaded composition or a core-sheath structure by coating the surface of the fiber formed by said kneaded composition with any other fiber material such as said chemical fiber materials.

Moreover, the highly moisture-absorptive fiber of this invention is obtained by mixing and kneading one or more kinds of animal protein fibers pulverized to very fine powder of the 0.05 to 15 μm size and water-soluble substances pulverized to very fine powder with a polymer of synthetic fiber, semi-synthetic fiber or regenerated fiber or polymer of chemical fiber material consisting of a mixture of more than two kinds of these polymers and spinning the kneaded composition, but during the spinning process, said pulverized water-soluble substances are removed by rinsing to form a number of pores consisting of wash-out traces in the fiber.

The method for forming the pores in the fiber as mentioned above is a chemical treatment process in which such pores are formed as wash-out traces of water-soluble substances. As the method for forming pores or slits in the fiber, however, the physical process in which such slits are formed through the curing and contraction of film on the sheath side of said core-sheath structure, and the mechanical process in which such slits or pores are formed by acting a cutter or needle on the surface of fiber can also be used.

On the other hand, it is needless to say that a hollow yarn or modified cross-section yarn can be made by changing the nozzle cross-section at the time of spinning the polymer of chemical fiber material. The hollow yarn is made by injecting and arranging the water-soluble substances continuously in the fiber direction at the time of spinning the polymer of chemical fiber material, and removing said water-soluble substances pulverized to very fine powder by rinsing in the spinning process to form hollow parts consisting of continuous wash-out traces in the fiber direction.

Moreover, the modified cross-section yarn is made by injecting and arranging the water-soluble substances continuously in the fiber direction and in such manner as to be partly exposed on the surface of fiber at the time of spinning the polymer of chemical fiber material, and removing said water-soluble substances pulverized to very fine powder by rinsing in the spinning process to form continuous wash-out traces concavely recessed from the surface of fiber in the fiber direction.

Said water-soluble substances means saccharide such as water-soluble gelatin, starch, and in organic compound such as salt.

Another highly moisture-absorptive fiber of this invention is also featured in that one or more kinds of animal protein fibers pulverized to very fine powder of the 0.05 to 15 μm size to be mixed and kneaded with a polymer of synthetic fiber, semi-synthetic fiber or regenerated fiber or polymer of chemical fiber material consisting of a mixture of more than two kinds of these polymers has previously been dried to the moisture content of less than 300 ppm.

In addition, said fiber can be dyed with acid dye to obtain the mottled effect.

To be concrete, the addition rate of animal protein fibers pulverized to very fine powder to be mixed and kneaded with the polymer is 1 to 99 wt. %.

As said chemical fiber material, the following materials can be used effectively.

Synthetic fiber materials: Polyurethane, acryl, vinylon, vinylidene, polyvinyl chloride, polyethylene, polypropylene, nylon, polyester, etc.

Semi-synthetic fiber materials: Acetate, diacetate, triacetate, etc.

Regenerated fiber materials: Rayon, etc.

It is well known that natural leather as one of animal protein fibers is a material very excellent in moisture absorptivity, moisture permeability and touch.

The fiber of this invention as described above was so structured that the animal portein fiber pulverized to very fine powder of the 0.05 to 15 μm size was mixed and kneaded with chemical fiber material to improve the moisture-absorptive characteristics, moisture permeable characteristics and touch.

The results of its improvement are given below.

EXPERIMENT 1

FIG. 1 is a graph showing the relation of moisture absorption quantities in the humid atmosphere. The highly moisture-absorptive fiber A of this invention obtained by adding and mixing 30 wt. % of oxhide or cowhide pulverized to powder ranging from 0.05 to 15 μm in particle size and having a mean particle size of 5 μm with polyurethane resin and spinning a multiple number of fiber bundles into 100 denier yarn, hydrophilic urethane resin yarn B spun to the same thickness as the highly moisture-absorptive fiber, and ordinary urethane resin yarn C were selected as comparative materials.

As is clear from FIG. 1, the highly moistrue-absorptive fiber A added with oxhide or cowhide pulverized to very fine powder is far more excellent in moisture absorptivity than the hydrophilic urethane resin yarn B and ordinary urethane resin yarn C.

EXPERIMENT 2

FIG. 2 is a graph showing the moisture absorption characteristics when the atmosphere was changed from room temperature 23° C. and humidity 30% to room temperature 30° C. and humidity 80%, and FIG. 3 is a graph showing the moisture desorption characteristics when the atmosphere was changed from room temperature 30° C. and humidity 80% to room temperature 23° C. and humidity 30%.

The yarn A by the porous structure fiber of this invention obtained by adding and mixing 33 wt. % of oxhide or cowhide pulverized to powder ranging from 0.05 to 15 μm in particle size and having a mean particle size of 5 μm and 20 wt. % of water-soluble gelatin pulverized to powder having a mean particle size of 5 μm with polyurethane resin, spinning the material as a fiber into 20 denier yarn, and giving a number of wash-out traces in the fiber by rinsing out the gelatin in the spinning process, the nylon resin yarn D spun to the same thickness as the yarn A and ordinary urethane resin yarn E were selected as comparative materials.

As is shown in FIGS. 2 and 3, the yarn A is far more excellent both in moisture-absorptivity and moisture-desorptivity than the nylon resin yarn D and urethane resin yarn E. It is therefore obvious that the yarn A mixed and kneaded with the animal protein fiber has an excellent moisture-absorption performance. And, the moisture absorbed by the yarn A will be rapidly desorbed as the humidity in the atmosphere is lowered.

As is clear from the graph of this Experiment 2, the moisture absorbed by the highly moisture-absorptive fiber A will be rapidly desorbed as the humidity in the atmosphere is lowered, and the moisture absorption and desorption speeds are very high.

As is obvious from the results of Experiments 1 and 2, the highly moisture-absorptive fiber of the present invention is excellent not only in the moisture-absorptivity, but also in the moisture-desorptivity. Therefore, in the case when the fiber is knitted or woven into a sheet and the sheet is used, for example, as clothes, the sweat or water vapor may move easily from the high humidity atmosphere on the skin side to the low humidity atmosphere on the open-air side.

This characteristic may also be exhibited by the core-sheath structure fiber consisting of the yarn A as a core fiber and the thin film coating of polymer applied as a sheath on the surface of the yarn A. By spinning this fiber, the yarn of highly moisture-absorptive fiber having an excellent moisture-absorptivity and moisture-desorptivity can be obtained.

Furthermore, since the sheath portion can maintain the spinning property as the result of said core-sheath structure, higher weight ratio of animal protein fiber powder can be mixed and kneaded with the core fiber.

The highly moisture-absorptive fiber of the present invention having a porous structure becomes excellent particularly in the moisture-absorptivity and moisture-desorptivity and is higher in flexibility of fiber due to its porous structure. Therefore, in case that the yarns spun from this fiber are knitted or woven as a fabric or made as a non-woven fabric and the fabric is used, for example, as clothes, the clothes permit easy movement of sweat or water vapor from the high humidity atmosphere on the skin side to the low humidity atmospher on the open-air side, and have flexibility.

Further, as for dyeing, since one or more kinds of animal protein fibers pulverized to very fine powder and water-soluble substances pulverized to very fine powder are exposed on the fiber surface of chemical fiber material consisting of polymer of synthetic fiber, semi-synthetic fiber or regenerated fiber or mixture of two or more kinds of these polymers, and the animal protein fiber can be easily dyed with acid dye, but the chemical fiber material can hardly be dyed with acid dye, spotted patterns will be observed under a microscope.

Therefore, the highly moisture-absorptive fiber of the present invention as mentioned above has the following characteristics and can be freely knitted or woven.

(1) Since not only natural leather, but also all kinds of animal protein fibers can be utilized, its commercial use can be widely promoted.

(2) Since the animal protein fiber to be added, mixed and kneaded is pulverized to very fine powder of 0.05 to 15 μm size, a very fine fiber can be obtained.

(3) Since the animal protein fiber pulverized to very fine powder of 0.05 to 15 μm size has previously been dried to the moisture content of less than 300 ppm before its mixing and kneading with the chemical fiber material, good spinning property can be secured.

(4) Since a number of pores are made in the fiber by the chemical process in which wash-out traces are formed at the time of spinning by adding the water-soluble substances pulverized to very fine powder to the chemical fiber material, physical process in which slits are formed on the surface of the core-sheath structure, or mechanical process in which slits or pores are pierced on the surface of fiber, the fiber can be softened to improve its spinning property.

(5) The porous structure as mentioned above makes it possible to realize rapid moisture absorption or moisture desorption.

(6) By adding the animal protein fiber pulverized to very fine powder of 0.05 to 15 μm size to the chemical fiber material on the core side or sheath side of the core-sheath structure fiber consisting of a core and a sheath, higher addtion rate of such animal protein fiber powder can be achieved.

Therefore, the fabric material woven or knitted from yarns obtained from the highly moisture-absorptive fiber of said structure has the following features:

(1) It is excellent in moisture-absorptivity and moisture-desorptivity and can thus give dry touch.

(2) It has the feeling similar to that of natural fiber.

(3) It does never cause dew condensation even if it is used in the low temperature atmosphere, thus suppressing the chill feeling. Moreover, owing to the dyeing characteristics of fibers for acid dye:

(4) The yarns of which fiber bundle is composed of said fiber are dyed deeper than the yarns composed only of the chemical fiber material. Therefore:

(5) By blending the yarns of which fiber bundle is composed of said fiber with the yarns composed only of the chemical fiber material, the spotted pattern can be formed on the plain cloth knitted or woven therefrom.

Namely, the highly moisture-absorptive fiber of the present invention can give a very fine fiber having flexibility and proper elongation, and being excellent in dyeing property and suited for knitting or weaving, in addition to the fact that the material to be added, mixed and kneaded is not limitted only to natural leather. Moreover, the highly moisture-absorptive fiber has also the features in that it does never cause dew condensation even if it is used in the low temperature atmosphere because of its excellent rapid moisture-absorptivity and moisture-desorptivity and excellent vapor-permeability. Therefore, the fabric material knitted or woven from this fiber is useful not only as ordinary clothing materilas, but also especially as materials for sports goods as may often be subject to sweating. Further, it may be used also as facing materials for bags, shoes and interior goods, as foundation fabric of artificial leather and synthetic leather for car interior finish such as steering cover, or as flocks for flocked materials and as bedding (futon) wadding.

In addition, the highly moisture-absorptive fiber of the present invention has the features in that since the yarns of which fiber bundle is composed of said fiber are dyed deeper than the yarns composed only of the chemical fiber material owing to the dyeing characteristics of fibers for acid dye, unique spotted pattern can be formed on the fabric woven or knitted from the yarns of which fiber bundle is composed of said fiber and the yarns composed only of the chemical fiber material.

Various other features and attendant advantages of the present invention will become more apparent from the following detailed description, referring to the accompanying drawings.

DETAILED DESCRIPTION OF THE PREFERRED EMBODIMENT

In the following, the examples of the highly moisture-absorptive fiber of the present invention will be described.

EXAMPLE 1

20 wt. % of oxhide or cowhide pulverized to powder ranging from 0.05 to 15 μm in particle size and having a mean particle size of 5 μm is added to and fully mixed and kneaded with the polyurethane resin dissolved in dimethylsulfoxide to prepare the uniformly dispersed kneaded composition. At this time, the pulverized oxhide or cowhide is dried at 120° C. for two hours (pre-drying) to the moisture content of 200 ppm. This kneaded composition is subjected to wet spinning to obtain 100 denier of yarn discharged as a fiber bundle.

By pre-drying the oxhide or cowhide powder, end breakage during spinning could be eliminated.

Figure 1:
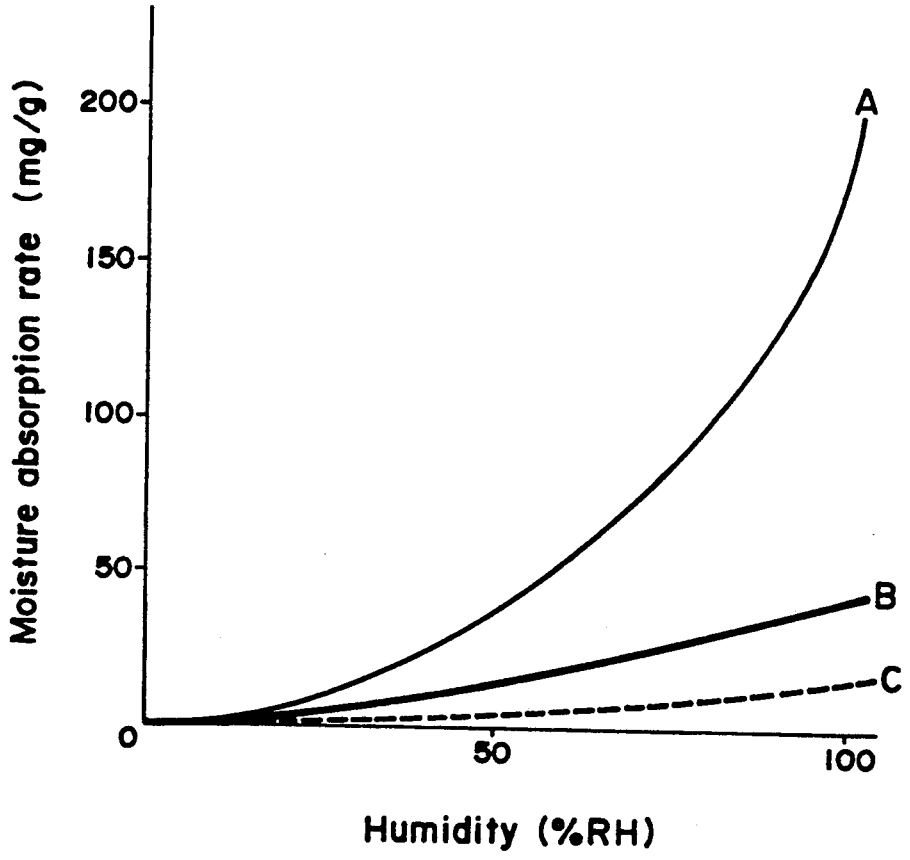
FIG. 1 is a graph showing the relation of moisture absorption quantities in the humid atmosphere in Experiment 1 in which the highly moisture-absorptive fiber of the present invention is compared with the conventional moisture absorptive fibers.
Figure 2:
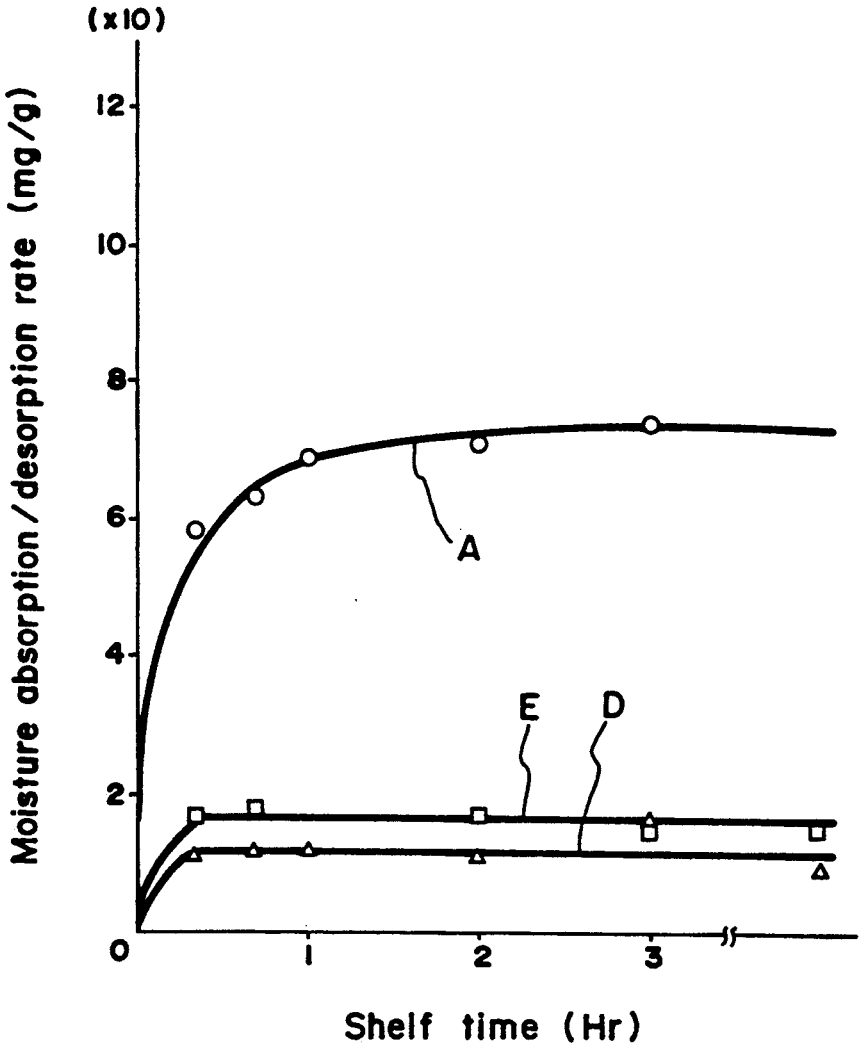
FIG. 2 is a graph showing the relation of moisture absorption quantities in the humid atmosphere in Experiment 2 in which the highly moisture-absorptive fiber of the present invention is compared with the conventional moisture absorptive fibers.
Figure 3:
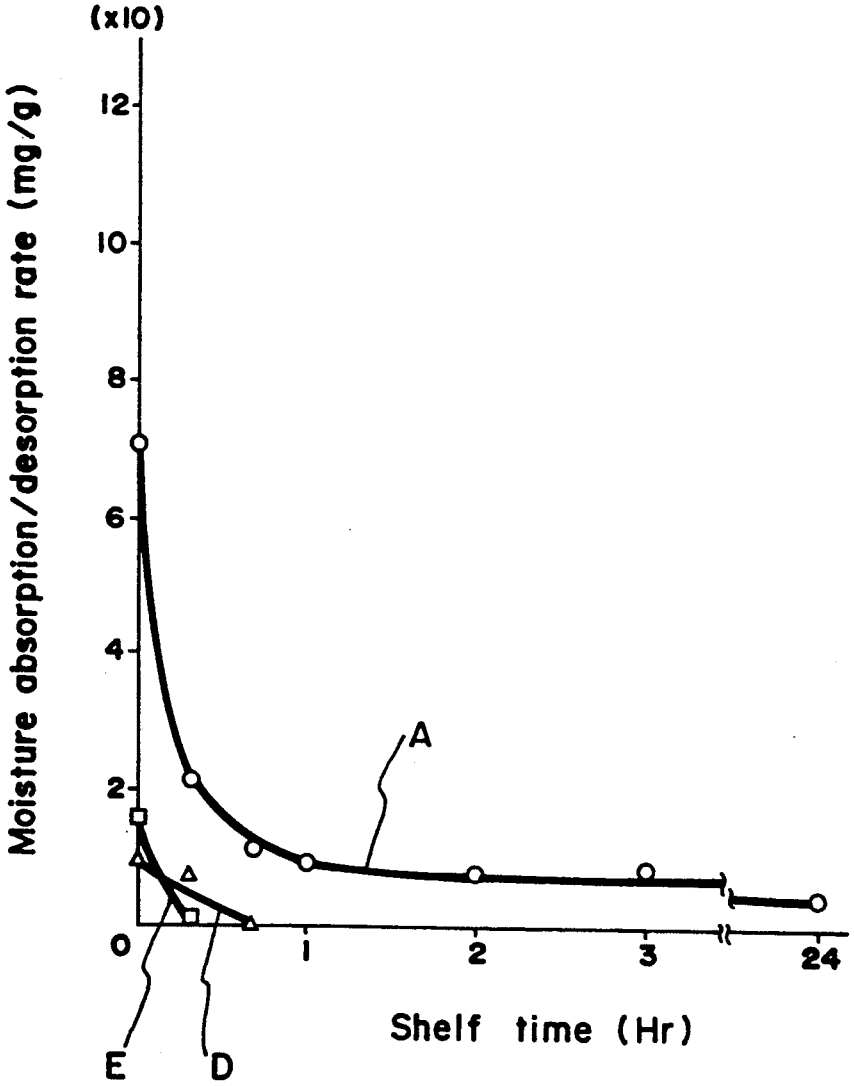
FIG. 3 is a graph showing the moisture-absorption and desorption characteristics of the highly moisture-absorptive fiber of the present invention.
Figure 4:
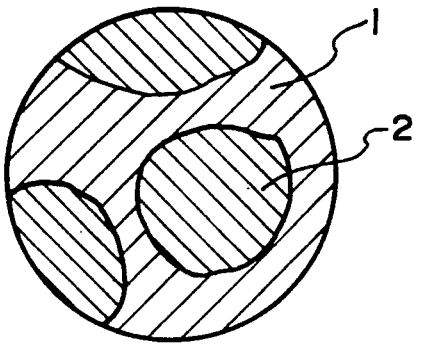
FIGS. 4 to 12 are enlarged schematic views showing the embodiments of the highly moisture-absorptive fiber of the present invention.

FIG. 4 is an enlarged schematic view showing the cross-section of this fiber. In this figure, 1 is the polyurethane resin fiber proper, and 2 is the pulverized oxhide or cowhide.

EXAMPLE 2

20 wt. % of oxhide or cowhide pulverized to powder ranging from 0.05 to 15 μm in particle size and having a mean particle size of 5 μm, and 20 wt. % of water-soluble gelatin pulverized to a mean particle size of 5 μm are added to and fully mixed and kneaded with the polyurethane resin solution dissolved in dimethylsulfoxide.

At this time, the pulverized oxhide or cowhide is dried at 120° C. for more than two hours to the moisture content of 200 ppm.

Through the process as mentioned above, 10 denier of fiber was obtained by wet spinning. Moreover, the water-soluble gelatin powder added together with the oxhide or cowhide was dissolved in water in the spinning bath. Further, by pre-drying the oxhide or cowhide powder, end breakage during spinning could be eliminated.

Figure 5:
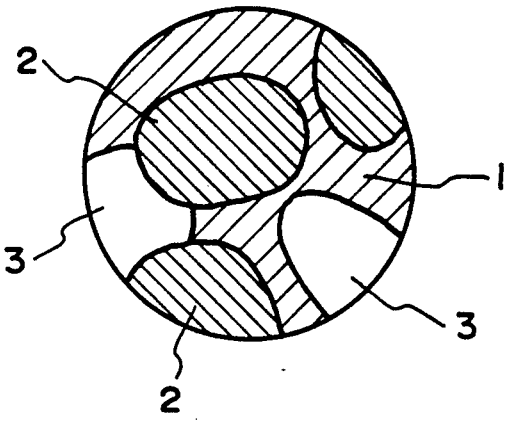

FIG. 5 is an enlarged schematic view showing the cross-section of this fiber. In this Figure, 1 is the polyurethane resin fiber proper, 2 is the pulverized oxhide or cowhide, and 3 is the pore formed by wash-out traces of the pulverized water-soluble gelatin. The fiber of porous structure was thus obtained.

EXAMPLE 3

10 wt. % of oxhide or cowhide pulverized to powder ranging from 0.05 to 15 μm in particle size and having a mean particle size of 1 μm, 10 wt. % of ox or cow bone pulverized to powder ranging from 0.05 to 15 μm in particle size and having a mean particle size of 1 μm, and 20 wt. % of water-soluble gelatin pulverized to a mean particle size of 1 μm are added to and fully mixed and kneaded with the acrylic resin solution dissolved in dimethylformamide. At this time, the pulverized oxhide or cowhide and ox or cow bone are dried at 120° C. for more than two hours to the moisture content of 200 ppm.

Through the process as mentioned above, 2 denier of very fine fiber was obtained by wet spinning. Moreover, the water-soluble gelatin powder added together with the oxhide or cowhide and ox or cow bone was dissolved in water in the spinning bath. Further, by pre-drying the oxhide or cowhide powder and the ox or cow bone, end breakage during spinning could be eliminated.

Figure 6:
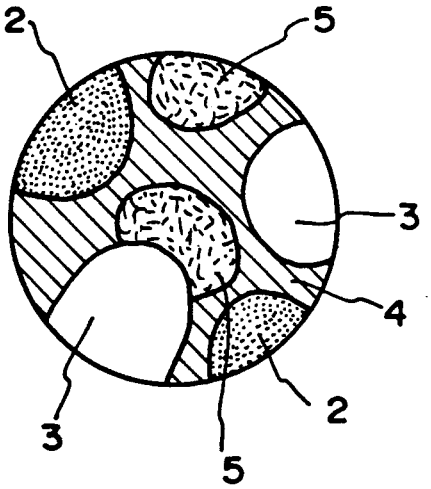

FIG. 6 is an enlarged schematic view showing the cross-section of this fiber. In this figure, 4 is the acrylic resin fiber proper, 2 is the pulverized oxhide or cowhide, 5 is the pulverized ox or cow bone, and 3 is the pore formed by wash-out traces of the pulverized water-soluble gelatin. The very fine fiber of porous structure was thus obtained.

EXAMPLE 4

50 wt. % of pigskin pulverized to powder ranging from 0.05 to 15 μm in particle size and having a mean particle size of 1 μm, and 20 wt. % of water-soluble gelatin pulverized to a mean particle size of 5 μm are added to and fully mixed and kneaded with the acrylic resin solution dissolved in dimethylformamide to prepare the uniformly dispersed kneaded composition.

At this time, the pulverized pigskin is dried at 120° C. for two hours to the moisture content of 200 ppm.

By coating this kneaded composition over the periphery of 3 denier of the core fiber spun from acrylic resin as a sheath by wet spinning, 7 denier of the fiber of core-sheath structure was obtained. The water-soluble gelatin powder added together with the pigskin was dissolved in water in the spinning bath.

Figure 7:
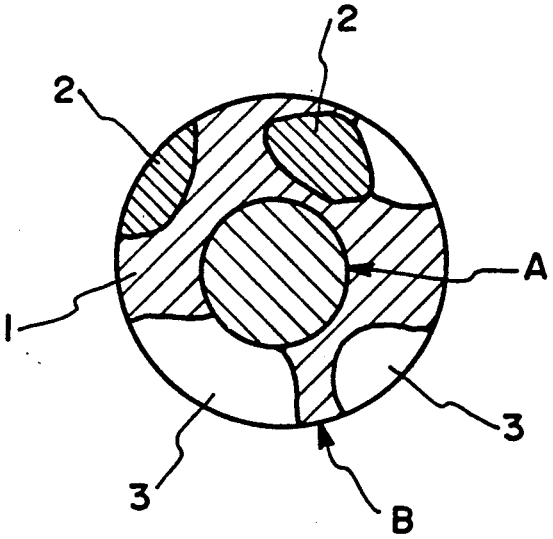

FIG. 7 is an enlarged schematic view showing the cross-section of this fiber. In this figure, A is the core part consisting of acrylic resin and B is the sheath part. In the sheath part B, the pulverized pigskin 2 exists in the coating consisting of the acrylic resin solution 1, and pores 3 are formed by the wash-out traces of pulverized water-soluble gelatin. The porous fiberof core-sheath structure was thus obtained.

EXAMPLE 5

40 wt. % of oxhide or cowhide pulverized to powder ranging from 0.05 to 15 μm in particle size and having a mean particle size of 0.5 μm is added to and fully mixed and kneaded with the acrylic resin solution dissolved in dimethylformamide to prepare the uniformly dispersed kneaded composition.

At this time, the pulverized oxhide or cowhide is dried at 120° C. for more than two hours (pre-drying) to the moisture content of 200 ppm.

This kneaded composition is subjected to wet spinning to obtain 9 denier of the fiber of core-sheath structure.

Over the periphery of the core fiber obtained through the process as mentioned above, acrylic resin was applied as a sheath-like coating by spinning to obatin 10 denier of the fiber of core-sheath structure.

Figure 8:
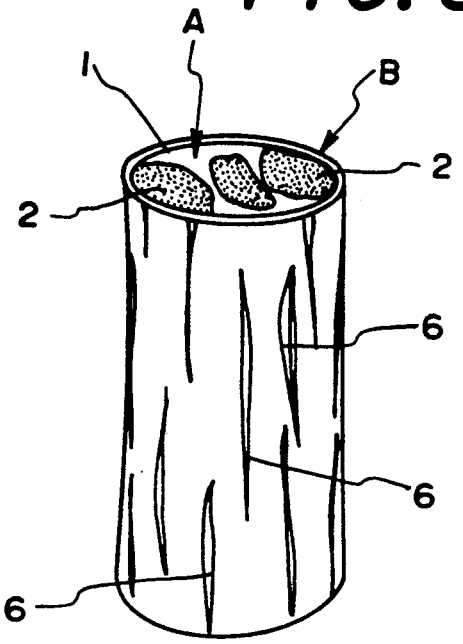

As is shown in FIG. 8, this fiber is of the core-sheath structure in which on the periphery of the core fiber A consisting of the pulverized oxhide or cowhide 2 existing at high mix ratio in the acrylic resin, a very thin coating B consisting of acrylic resin is formed. In this core-sheath structure, a number of slit-like pores 6 are formed by circumferential tensile force caused at the time when the acrylic resin fiber is cured and contracted, and the core fiber is exposed through such pores. Moreover, by pre-drying the oxhide or cowhide 2, the spinning property could be significantly improved.

EXAMPLE 6

20 wt. % of oxhide or cowhide pulverized to powder ranging from 0.05 to 15 μm in particle size and having a mean particle size of 5 μm, 20 wt. % of cocoon thread pulverized to powder ranging from 0.05 to 15 μm in particle size and having a mean particle size of 5 μm, and 20 wt. % of water-soluble gelatin pulverized to a mean particle size of 5 μm are added to and fully mixed with the polyurethane resin solution dissolved in dimethylsulfoxide.

At this time, the pulverized oxhide or cowhide is dried at 120° C. for more than two hours (pre-drying) to the moisture content of 200 ppm.

Through the process as mentioned above, 20 denier of fiber was obtained by wet spinning. Moreover, the water-soluble gelatin powder added together with the oxhide or cowhide and cocoon thread was dissolved in water in the spinning bath. Further, by pre-drying the oxhide or cowhide powder, end breakage during spinning could be eliminated.

Figure 9:
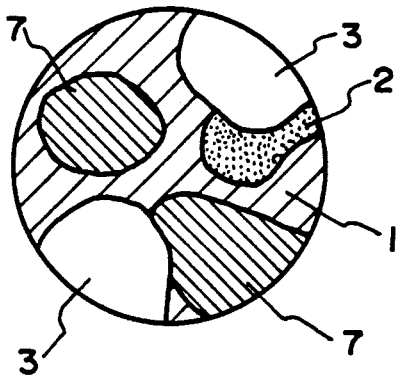

FIG. 9 is an enlarged schematic view showing the cross-section of this fiber. In this figure, 1 is the polyurethane resin fiber proper, 2 is the pulverized oxhide or cowhide, 7 is the pulverized cocoon thread, and 3 is the pore formed by wash-out traces of the pulverized water-soluble gelatin. The fiber of porous structure was thus obtained.

EXAMPLE 7

20 wt. % of pigskin pulverized to powder ranging from 0.05 to 15 μm in particle size and having a mean particle size of 1 μm, 20 wt. % of wool pulverized to powder ranging from 0.05 to 15 μm in particle size and having a mean particle size of 1 μm, and 20 wt. % of water-soluble gelatin pulverized to a mean particle size of 5 μm are added to and fully mixed about kneaded with the polyurethane resin solution dissolved in dimethylsulfoxide to prepare the uniformly dispersed kneaded composition.

At this time, the pulverized pigskin is dried at 120° C. for two hours to the moisture content of 200 ppm.

By coating this kneaded composition over the periphery of 3 denier of the core fiber spun from polyurethane resin as a sheath by wet spinning, 7 denier of the fiber of core-sheath structure was obtained. The water-soluble gelatin powder added together with the pigskin and wool powder was dissolved in water in the spinning bath.

Figure 10:
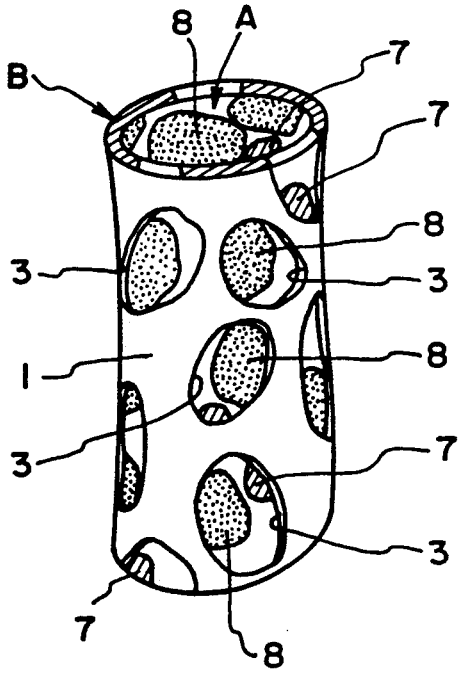

This fiber has a struture as shown in FIG. 10. In this figure, A is the core part consisting of polyurethane resin, and B is the sheath part. In the sheath part B, the pulverized pigskin 8 and pulverized wool 7 exist in the coating consisting of the polyurethane resin solution 1, and pores 3 are formed by the wash-out traces of pulverized water-soluble gelatin. The porous fiber of core-sheath structure was thus obtained.

Said pores 3 are the wash-out traces of added and mixed water-soluble substance to be formed by chemical treatment in which such substance is rinsed out at the time of spinning. Slits 6 are formed by physical characteristics resulting from the thermal and/or phase change of material.

In addition, it is needless to say that, according to the present invention, slits or pores can be formed mechanically by providing cutter or needle moving toward and back from the internal surface of fiber extraction nozzle and causing such cutter or needle to act on the fiber surface at the time of fiber discharging.

EXAMPLE 8

20 wt. % of oxhide or cowhide pulverized to powder ranging from 0.05 to 15 μm in particle size and having a mean particle size of 5 μm and 20 wt. % of crab carapace pulverized to powder ranging from 0.05 to 15 μm in particle size and having a mean particle size of 5 μm are added to and fully mixed with the polyurethane resin solution dissolved in dimethylsulfoxide.

At this time, the pulverized oxhide or cowhide is dried at 120° C. for more than two hours (pre-drying) to the moisture content of 200 ppm.

Through the process as mentioned above, the kneaded composition is extracted by wet spinning as 20 denier of fiber. Upon this extraction, water-soluble gelatin extending in the fiber direction was extracted on the cross-section of fiber through a multiple number (three pieces in this embodiment) of auxiliary nozzles arranged on the cross-section of nozzle. Moreover, the water-soluble gelatin was dissolved in water in the spinning bath.

Figure 11:
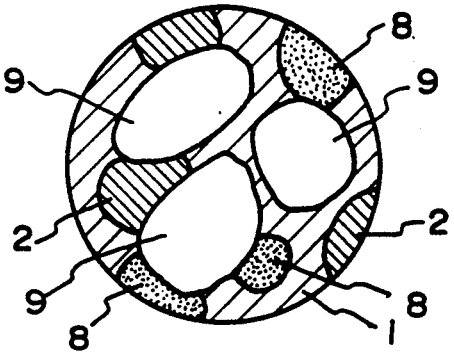

FIG. 11 is an enlarged schematic view showing the cross-section of this fiber. In this figure, 1 is the polyurethane resin fiber proper, 2 is the pulverized oxhide or cowhide, 8 is the pulverized crab carapace, and 9 is the hollow part formed by wash-out traces of the water-soluble gelatin. The hollow fiber was thus obtained.

Further, it is needless to say that the hollow parts in the hollow fiber can be formed in various numbers or shapes by changing the nozzle structure.

EXAMPLE 9

20 wt. % of pigskin pulverized to a mean particle size of 3 μm and 10 wt. % of cocoon thread pulverized to a mean particle size of 5 μm are added to and fully mixed with the acrylic resin solution dissolved in dimethylformamide.

At this time, the pulverized pigskin is dried at 120° C. for more than two hours (pre-drying) to the moisture content of 200 ppm.

Through the process as mentioned above, the kneaded composition is extracted through a nozzle by wet spinning as 20 denier of fiber. On the cross-section of said nozzle, auxiliary nozzles are arranged offset. At the time of fiber extraction, water-soluble gelatin exposed at one end and extending in the fiber direction was extracted on the cross-section of fiber through the auxiliary nozzles to obtain the fiber. Moreover, the water-soluble gelatin was dissolved in water in the spinning bath.

Figure 12:
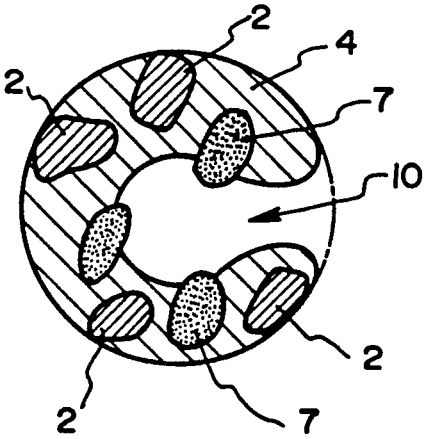

FIG. 12 is an enlarged schematic view showing the cross-section of this fiber. In this figure, 4 is the acrylic resin fiber proper, 2 is the pulverized pigskin, 7 is the pulverized cocoon thread, and 10 is the concave recesses formed by wash-out traces of the water-soluble gelatin. According to the structure of concave recesses 10, the fiber having the modified cross-section of nearly C-shape was obtained.

Furthermore, said modified cross-section can be made in various shapes by changing the arrangement of auxiliary nozzles.

It should be added that the highly moisture-absorptive fibers obtained in said examples 1–9 had a very good spinning property without causing any end breakage in the spinning process.

While the invention has been particularly described with reference to its most preferred embodiment, it will be apparent that various other modifications and changes may be made to the present invention described above without departing from the spirit and scope thereof. Therefore, the present invention is not limited only to its particular embodiments. For example, as the polymer of chemical fiber material, the combination of the polymer of synthetic fiber material, semi-synthetic fiber material, and regenerated fiber material can be also used.

We claim:

1. A highly moisture-absorptive fiber obtained by spinning a mixture comprising one or more kinds of animal protein fibers pulverized to fine powder of 0.05 to 15 μm size, said fine powder having a moisture content of less than 300 ppm, and at least one polymer selected from the group consisting of a polymer of synthetic fiber material, a polymer of semi-synthetic fiber material and a polymer of regenerated fiber material.

2. A highly moisture-absorptive fiber comprising a core fiber and a sheath fiber formed on said core fiber, said sheath fiber obtained by spinning a mixture comprising one or more kinds of animal fibers pulverized to fine powder of 0.05 to 15 μm size, said fine powder having a moisture content of less than 300 ppm, and at least one polymer selected from the group consisting of a polymer of synthetic fiber material, a polymer of semi-synthetic fiber material and a polymer of regenerated fiber material so as to coat a surface of said core fiber.

3. A highly moisture-absorptive fiber comprising a core fiber and a sheath fiber formed on said core fiber, said core fiber obtained by spinning a mixture comprising one or more kinds of animal protein fibers pulverized to fine powder of 0.05 to 15 μm size, said fine powder having a moisture content of less than 300 ppm, and at least one polymer selected from the group consisting of a polymer of synthetic fiber material, a polymer of semi-synthetic fiber material and a polymer of regenerated fiber material, and said sheath fiber formed on said core fiber by spinning at least one polymer selected from the group consisting of a polymer of synthetic fiber material, a polymer of semi-synthetic fiber material and a polymer of regenerated fiber material.

4. The highly moisture-absorptive fiber as in claim 1, 2 or 3 in which a number of pores or slits are formed in a surface of the fiber, or in an inner part and on a surface of the fiber.

5. The highly moisture-absorptive fiber as in claim 4, in which the pores are formed by rinsing out a water soluble substance selected from an inorganic compound and a saccharide, added to said mixture during spinning.

6. The highly moisture-absorptive fiber as in claim 4, in which the slits are formed by contraction of the polymer constituting the sheath fiber during a curing of said polymer.

7. The highly moisture-absorptive fiber as in claim 4, in which the pores or the slits are formed mechanically by means of a cutter or needle acting on the fiber during the spinning.

8. The highly moisture-absorptive fiber as in claim 1, 2 or 3, in which the pores are formed in the inner part of the fiber by rinsing out a water soluble substance injected in a direction of the fiber during the spinning process so as to form a hollow structure in the inner part of the fiber.

9. The highly moisture-absorptive fiber as in claim 1, 2 or 3, in which the pores are formed on the surface of the fiber by rinsing out a water soluble substance injected in a direction of the fiber during the spinning process so as to be partly exposed on the surface of the fiber.

10. The highly moisture-absorptive fiber as in claim 1, 2 or 3, in which said fiber is dyed with acid dye to form a mottled pattern.

* * * * *